US010501281B1

(12) United States Patent
Newgent et al.

(10) Patent No.: US 10,501,281 B1
(45) Date of Patent: Dec. 10, 2019

(54) COILER BAR ASSEMBLY

(71) Applicants: James Newgent, Magnolia, TX (US); Tammy Newgent, Magnolia, TX (US)

(72) Inventors: James Newgent, Magnolia, TX (US); Tammy Newgent, Magnolia, TX (US)

( * ) Notice: Subject to any disclaimer, the term of this patent is extended or adjusted under 35 U.S.C. 154(b) by 42 days.

(21) Appl. No.: 16/027,012

(22) Filed: Jul. 3, 2018

(51) Int. Cl.

| | |
|---|---|
| ***B65H 54/553*** | (2006.01) |
| ***B65H 54/44*** | (2006.01) |
| ***B65H 54/74*** | (2006.01) |
| ***B65H 49/32*** | (2006.01) |
| *B65H 18/02* | (2006.01) |
| *B65H 16/06* | (2006.01) |

(52) U.S. Cl.
CPC ..... *B65H 54/553* (2013.01); *B65H 49/321* (2013.01); *B65H 49/325* (2013.01); *B65H 54/44* (2013.01); *B65H 54/74* (2013.01); *B65H 16/06* (2013.01); *B65H 18/028* (2013.01); *B65H 2402/5221* (2013.01); *B65H 2402/63* (2013.01); *B65H 2701/36* (2013.01)

(58) Field of Classification Search
CPC ..... B65H 54/44; B65H 54/553; B65H 54/74; B65H 49/32; B65H 49/321; B65H 49/325; B65H 16/06; B65H 18/028; B65H 2402/5221; B65H 2402/63; B65H 2701/36
See application file for complete search history.

(56) References Cited

U.S. PATENT DOCUMENTS

| | | | | |
|---|---|---|---|---|
| 4,588,142 | A * | 5/1986 | Malzacher | B65H 54/2812 242/390.5 |
| 4,767,073 | A * | 8/1988 | Malzacher | B65H 54/2812 242/397.3 |
| 6,533,248 | B1 * | 3/2003 | Schafer | B65H 49/32 254/134.3 FT |
| 9,079,745 | B2 * | 7/2015 | Galindo Gonzalez | B65H 49/32 |
| 2012/0223179 | A1 * | 9/2012 | Galindo Gonzalez | B65H 49/32 242/598.5 |
| 2014/0070045 | A1 * | 3/2014 | Robinson | B65H 49/32 242/566 |

* cited by examiner

*Primary Examiner* — William E Dondero
(74) *Attorney, Agent, or Firm* — Law Office of Jeff Williams PLLC; J. Oliver Williams

(57) ABSTRACT

A coiler bar assembly includes a coupler housing and a bearing housing used to suspend a reel shaft above a surface. The reel shaft is configured to include bearings to permit its rotation relative to the housings. The coupler housing includes a receiving plate coupled to an end of the reel shaft and a coupler that is engaged with a motor shaft. The motor shaft extends up to the receiving plate. A handle is included and is pivotally coupled to the coupler housing and the coupler about two separate axes. Pivoting the handle permits translation of the coupler along the motor shaft to selectively engage the receiving plate. When engaged, rotation of the motor shaft induces rotation of the reel shaft. The handle is operated externally from the coupler housing.

20 Claims, 6 Drawing Sheets

COILER BAR ASSEMBLY

BACKGROUND

1. Field of the Invention

The present application relates to coiling machinery for the winding and unwinding of coil reels, and more particularly to a coiler bar assembly for selectively inducing rotation of a reel of line.

2. Description of Related Art

Metallic cables and wires are used in many types of applications within industry. These cables are stored typically on a reel or spool because these cables and wires are very long and the act of wrapping them around a cylindrical spool is a fairly efficient way to store, transport, and use them without concern for bending or creasing the cables. Coiling machinery is used to assist in the winding and unwinding of these spools of cable. Depending on the size of the cable and spool, these spools can be extremely heavy. The coiling machinery therefore has to be built to be very sturdy and stable. This machinery typically includes a means of elevating the spool off the floor and a means of counting the amount of cable unwound or wound. Spools rotate about a shaft. As these spools can be very large, the counter can slide on a track across the width of the coil machine. The purpose of the counter is to measure the length of line either wound onto the reel or unwound from the reel, depending on the direction of winding.

When the spool is elevated off the floor, it is ready to either accept or dispense line. A motor is coupled to the shaft and is configured to aid in inducing rotation about the shaft. This motor is usually a hydraulic motor or an electric motor. The shaft rotates across bearings located on each end. A disadvantage of these assemblies is that the bearings on the shafts are fairly small and lead to premature wear over time. Additionally, the process of engaging the motor to the shaft is complex. A simplified manner of engaging the shaft and motor is needed. Additionally, it is desired that a mechanical method be utilized for this selective engagement. Although strides have been made in coiling machinery, shortcomings remain.

SUMMARY OF THE INVENTION

It is an object of the present application to provide a coiler bar assembly for use with coiling machinery for the selective interchanging between a free rotating shaft to that of a motor driven shaft. The assembly is configured to provide an externally accessible activation lever used to manually engage and disengage the motor from a shaft used to hold the reel/spool of line. Operation in either of these positions helps to permit either free rotation of the shaft and spool or the motor assisted rotation. Motor assisted rotation may help to alleviate tensile stress in the line when unwinding and is useful in winding the spool to accept line.

It is a further object of the present assembly to increase the surface area of the bearings on the shaft. The bearings are widened and cradle over a third of the bearing. The increase in surface area in contact with the shaft helps to minimize the load per area. Weight is distributed to a greater degree. Ultimately the invention may take many embodiments. This assembly overcomes the disadvantages inherent in the prior art.

The more important features of the assembly have thus been outlined in order that the more detailed description that follows may be better understood and to ensure that the present contribution to the art is appreciated. Additional features of the assembly will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the assembly in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and assemblies for carrying out the various purposes of the present assembly. It is important, therefore, that the claims be regarded as including such equivalent constructions insofar as they do not depart from the spirit and scope of the present assembly.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
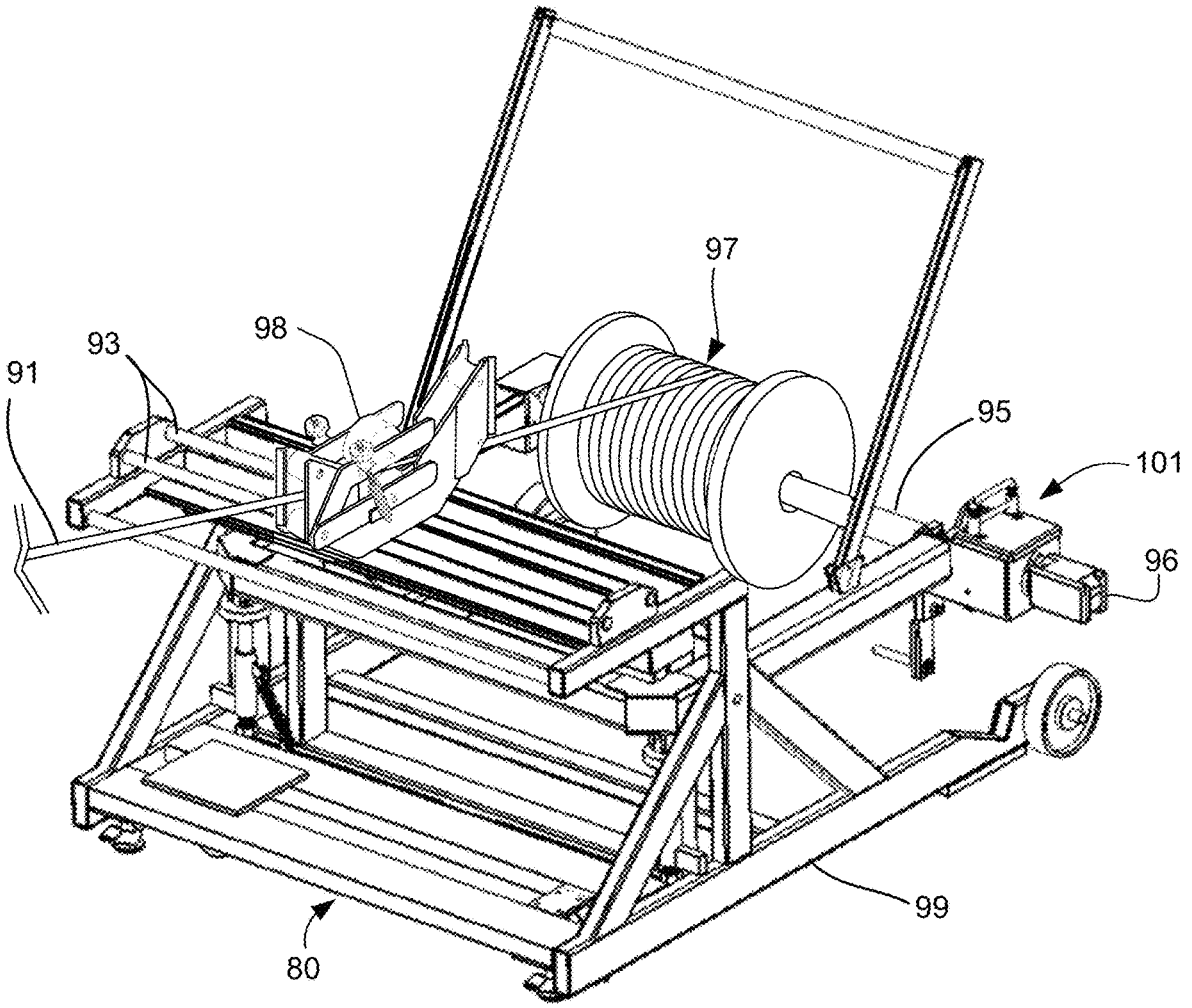
FIG. 1 is a perspective view of a coil bar assembly according to an embodiment of the present application in use on a coiling machine.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with assembly-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with conventional assemblies discussed previously. In particular, the coiler bar assembly is configured to provide an external means of selectively engaging and disengaging the motor from the shaft used to support the reel. Additionally the assembly is configured to minimize wear of the bearings on the shaft by increasing the size of the cradle surface. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a coupler housing and a bearing housing used to suspend a reel shaft above a surface. The reel shaft is configured to include bearings to permit its rotation relative to the housings. The coupler housing includes a receiving plate coupled to an end of the reel shaft and a coupler that is engaged with a motor shaft. The motor shaft extends up to the receiving plate. A handle is included and is pivotally coupled to the coupler housing and the coupler about two separate axes. Pivoting the handle permits translation of the coupler along the motor shaft to selectively engage the receiving plate. When engaged, rotation of the motor shaft induces rotation of the reel shaft. The handle is operated externally from the coupler housing. Additional features and functions of the assembly are illustrated and discussed below.

Referring now to the Figures wherein like reference characters identify corresponding or similar elements in form and function throughout the several views. The following Figures describe the assembly of the present application and its associated features. With reference now to the Figures, an embodiment of the counting assembly and method of use are herein described. It should be noted that the articles "a", "an", and "the", as used in this specification, include plural referents unless the content clearly dictates otherwise.

Referring now to FIG. 1 in the drawings, a perspective view of a coiler bar assembly 101 in use on a coiling machine is illustrated. Assembly 101 is configured to regulate the induced rotation of a reel of line on a coiling machine 80. Machine 80 has a frame 99 that is used to support the elevating of a reel 97 above the floor to permit rotation of such reel. Machine 80 is configured to include either electronic or hydraulic motors to perform selected tasks. One task is to control the elevation of reel 97. Another task may be to induce a rotation to reel 97 through the rotation of reel shaft 95. Reel 97 may rotate freely or may be regulated by the operation of motor 96. A counter assembly 98 translates side to side on a track 93 and is used to measure the length of line being wound or unwound from reel 97. Movement along track 93 occurs as the location of line 91 varies across reel 97. As line 91 passes through assembly 101, a counter tracks or converts the rotational movement of the roller into a linear measurement. It is understood that machine 80 may be made in different sizes and have some unique nuances, but the function is fairly consistent.

Figure 2:
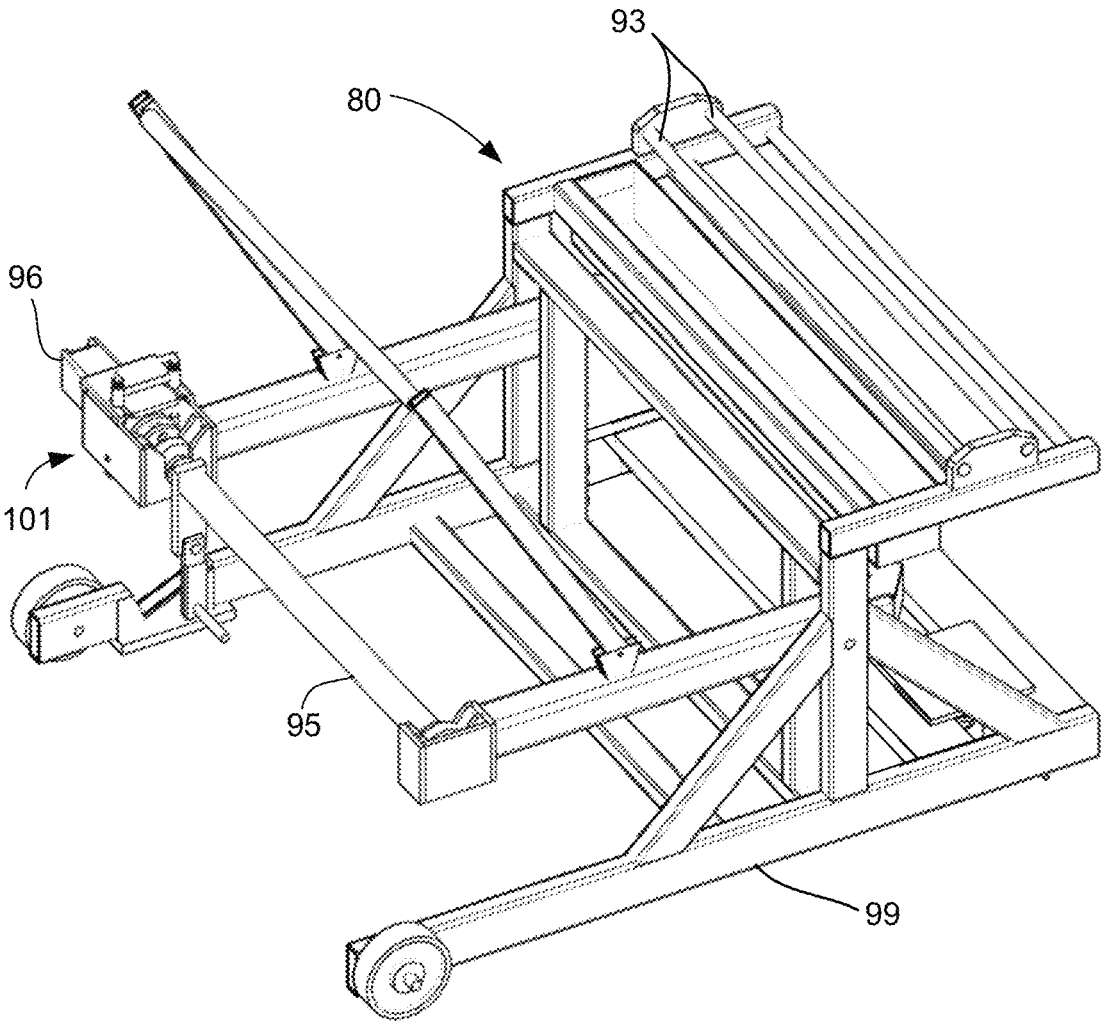
FIG. 2 is a simplified rear perspective view of the coiling bar assembly and coiling machine of FIG. 1.

Referring now to FIG. 2 in the drawings, a rear perspective view of assembly 101 on machine 80 is illustrated. In this view, reel 97, counter assembly 98, and line 91 are removed to provide a clearer view of coiler bar assembly 101. Coiler bar assembly 101 extends across two arms of frame 99. These arms are able to pivot up and down thereby permitting a user to regulate the elevation of reel 97.

Figure 3:
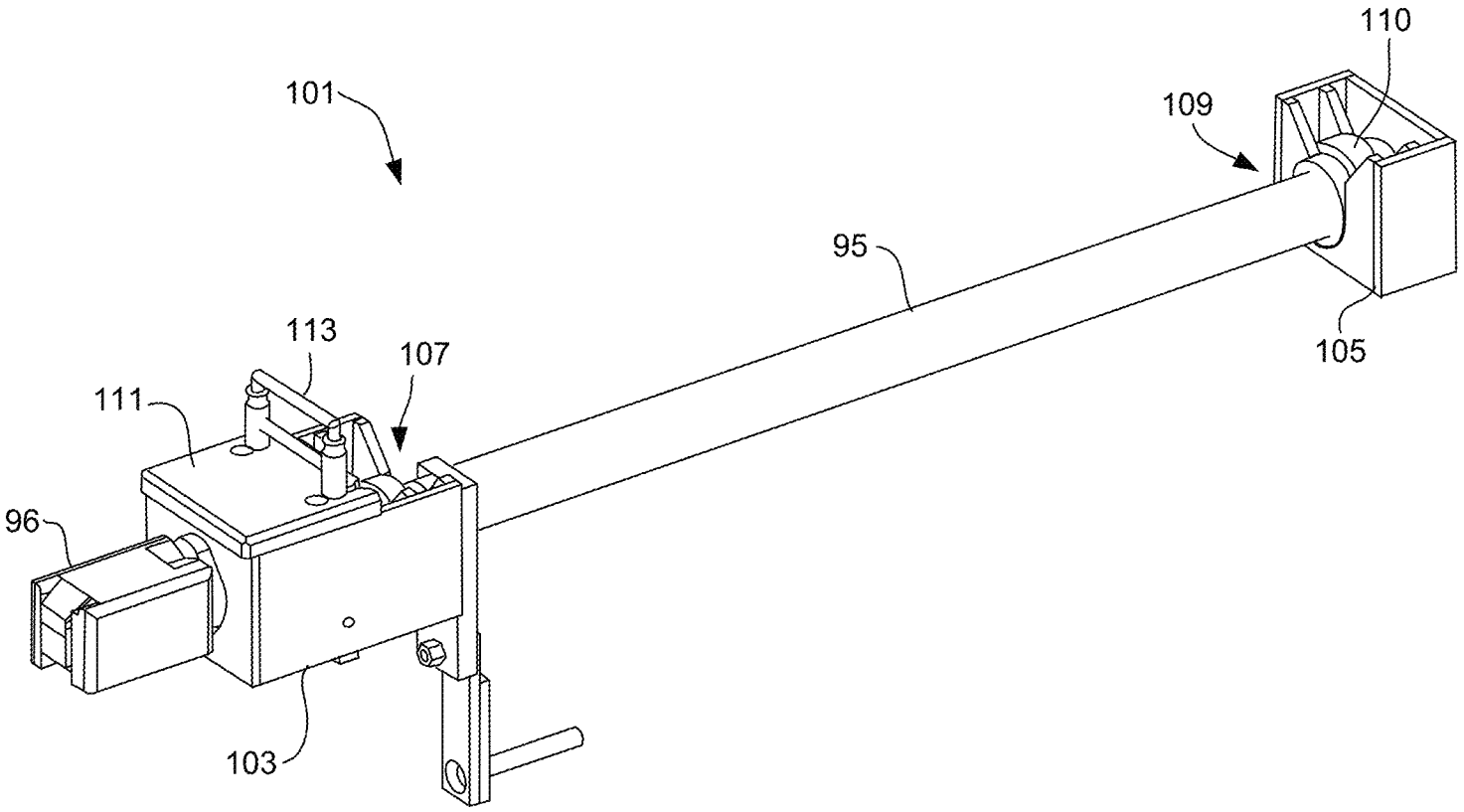
FIG. 3 is a perspective view of the coiler bar assembly of FIG. 2
Figure 4:
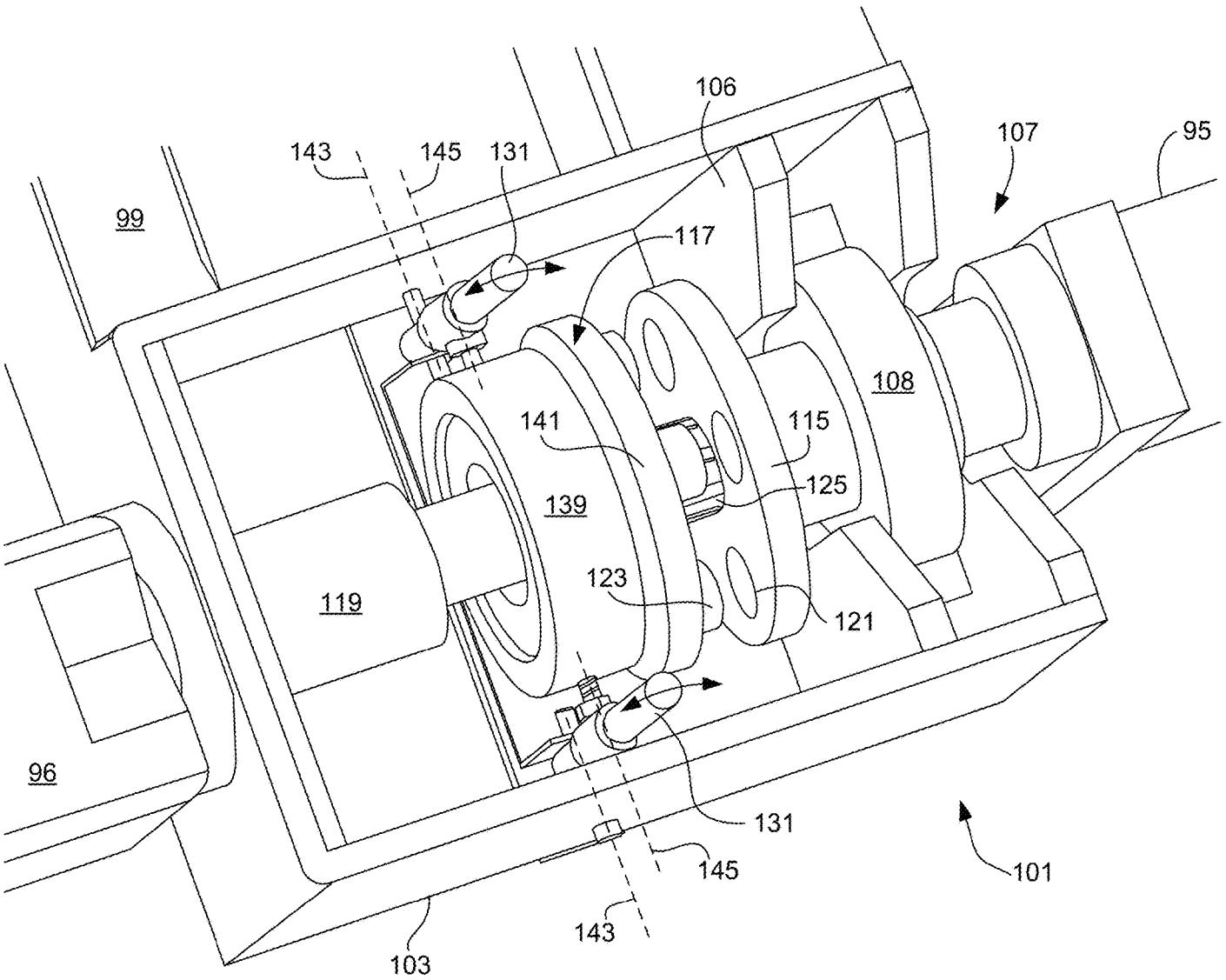
FIG. 4 is an interior perspective view within a coupler housing in the coiler bar assembly of FIG. 3.

Referring now also to FIGS. 3 and 4 in the drawings, a perspective view of coiler bar assembly 101 is illustrated. FIG. 3 is a view of assembly 101 as a whole. Assembly 101 includes a coupler housing 103, a bearing housing 105, and a reel shaft 95. Shaft 95 is configured to span the distance between the arms of frame 99. Shaft 95 has a cylindrical shape to permit smooth rotation about its length. Shaft 95 has a first end 107 and a second end 109. First end 107 is in communication with coupler housing 103 via a first bearing 108 (see FIG. 4). Second end 109 is in communication with bearing housing 105 via a second bearing 110. Coupler housing 103 includes a partition 106 used to separate bearing 108 from the rest of the internal components of housing 103. Coupler housing 103 also includes a lid 111. In FIG. 3, lid 111 is partially removed to permit a better view of first end 107. Also included within assembly 101 is a handle 113. Lid 111 and handle 113 are described in more detail with in FIGS. 5 and 6. It is understood that motor 96 is depicted but is not necessarily included in assembly 101. Alternate embodiments may include motor 96 within assembly 101.

FIG. 4 is an enlarged perspective view of the interior of coupler housing 103. Located within coupler housing 103 is a receiving plate 115, a coupler 117, handle 113, and motor shaft 119. Receiving plate 115 is coupled to first end 107 of shaft 95 outside, or more distal, than that of first bearing 108. A direct connection between receiving plate 115 and shaft 95 is made. As shaft 95 rotates freely, so rotates receiving plate 115. Motor shaft 119 extends from motor 96, through coupler housing 103 and passes through coupler 117. Motor shaft 119 ends adjacent a front face of receiving plate 115. Motor shaft 119 and shaft 95 are concentric.

As seen in FIG. 4, assembly 101 is illustrated in a disengaged position. This is done to permit a better view of the components within coupler housing 107. In this position, coupler 117 is separated from receiving plate 115. Shaft 95 may therefore rotate freely. Coupler 117 is configured to also operate in an engaged position. In such a position, coupler 117 is translated forward along motor shaft 119 so as to mate with receiving plate 115. Receiving plate 115 includes a plurality of apertures 121 and coupler 117 includes a plurality of studs 123. Studs 123 are radially spaced about the axis of shaft 119 equal to that of the radial spacing of apertures 121 about shaft 95. This alignment allow studs 123 to pass through apertures 121. In this position, the faces of coupler 117 and receiving plate 115 come together.

In order to induce a rotation force onto shaft 95 when coupler 117 is engaged with receiving plate 115, at least a portion of motor shaft 119 must include a keyed surface 125 such as at least one of a groove or teeth for example. As seen in FIG. 4, keyed surface 125 extends outward from a surface of shaft 119. The keyed surface 125 is matched with an internal surface of coupler 117. Therefore in the engaged position, coupler 117 is engaged with keyed surface 125 and any rotation of coupler 117 is transferred accordingly to receiving plate 115. It is understood that the surfaces of receiving plate 115 and coupler 117 may act similarly to that of a clutch system wherein the faces include contours that grip when contacted together. Although many types of methods exist to engage coupler 117 to receiving plate 115, the present embodiment is not herein limited to that which is shown. Of importance is that when brought together into the second position (engaged position), the rotational motion of the shaft 119 is transferred through coupler 117 and to receiving plate 115.

Figure 5:
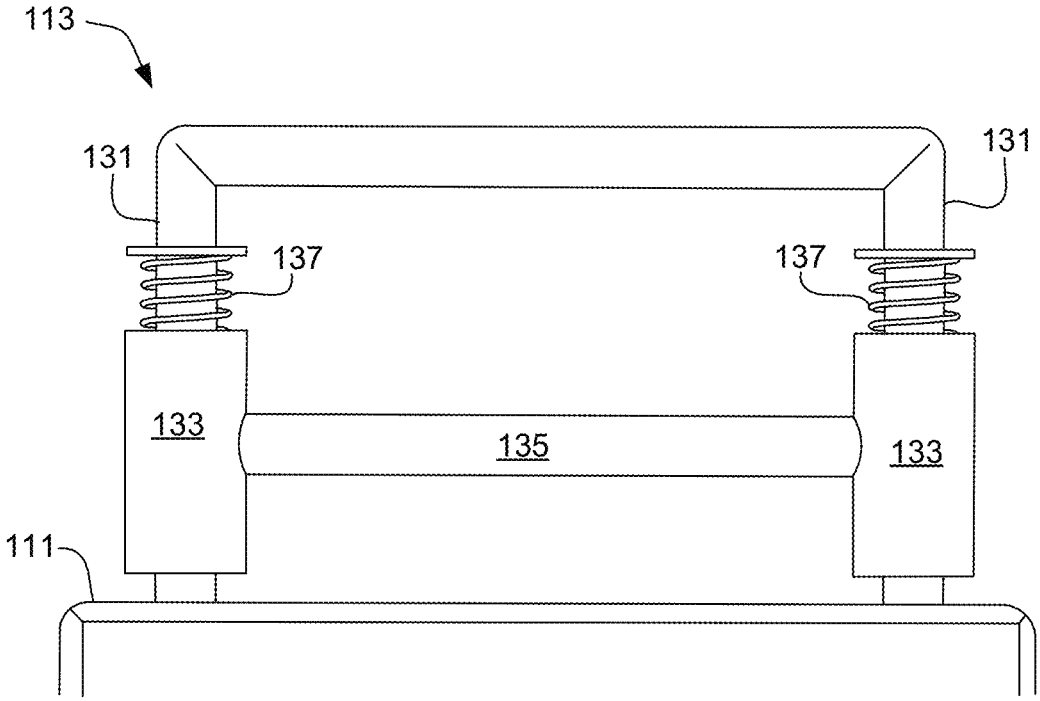
FIG. 5 is a side view of an activation lever used in the coiler bar assembly of FIG. 3.
Figure 6:
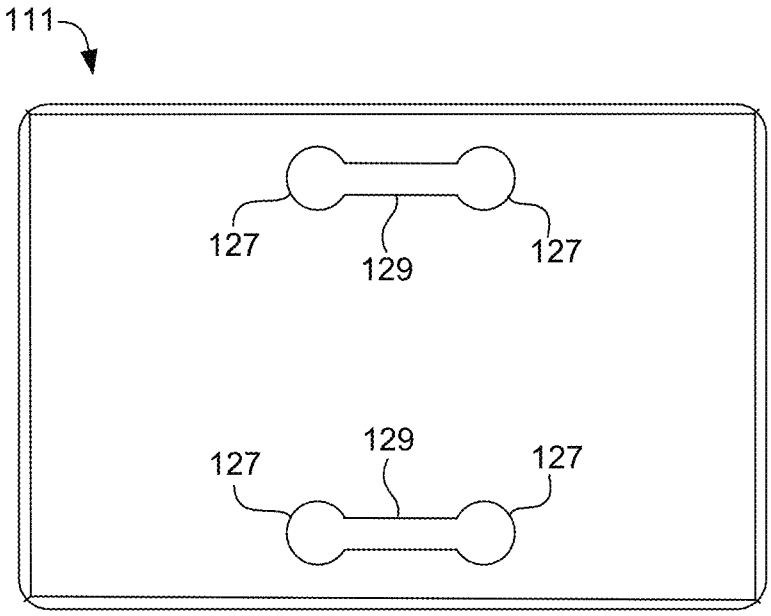
FIG. 6 is a top view of a lid in the coiler bar assembly of FIG. 3.

Referring now also to FIGS. 5 and 6 in the drawings, views of handle 113 and lid 111 are provided. As seen in FIG. 6, lid 111 is shown via a top view in its full form. Lid 111 is configured to cover coupler housing 113 and to permit handle 113 to pass there through. Lid 111 includes at least one set of apertures 127. The set of apertures 127 are connected via a slot 129. Apertures 127 and slot 129 are configured to pass through lid 111. The width of slot 129 is less than the diameter of apertures 127. Slot 129 is aligned with the orientation of shaft 119.

FIG. 5 shows a side view of the portion of handle 113 that is external to coupler housing 103. Handle 113 includes a pair of vertical members 131 that are surrounded by a translating sleeve 133 located on each respective member 131. The sleeves 133 are coupled together through a cross brace 135 and are configured to move linearly along the length of vertical members 131. A biasing member 137 is in communication with members 131 and sleeves 133 so as to locate sleeves 133 relative to members 131. As shown, above the sleeve 133 is biasing member 137. As seen in FIG. 5, an example of a biasing member 137 is a spring. Member 137 is configured to maintain a resting position of sleeve 133 in a lowered position. Pulling up on brace 135 compresses biasing members 137 and raises sleeves 133 to an upper position. As seen in FIG. 4, sleeves 131 are in an upper position to show them fully elevated above lid 111. Sleeves 133 are sized to match (slightly smaller) the diameter of apertures 127, but are larger than the width of slot 129. The diameter of vertical members 131 are less than the width of slot 129 so as to permit passage of handle 113 between apertures 127. In going between apertures 127, sleeve 133 is raised above lid 111 and vertical members 131 are passed through slot 129 to the opposing aperture 127. At this time, sleeve 133 is lowered to its resting position from biasing member 137 such that sleeve 133 passes through aperture 127. Movement of handle 113 is now restrained. It is understood that one or more vertical members 131 may be used in different embodiments. Handle 113 permits a user to manipulate the engagement of motor 96 with shaft 95 via an external lever.

Referring back to FIG. 4 in the drawings, coupler 117 includes a coupler bearing 139 and a coupler plate 141. Coupler plate 141 includes studs 123 and directly engages receiving plate 115. Coupler bearing 139 selectively contacts a back surface of coupler plate 141. Coupler plate 141 and coupler bearing 139 are independently coupled to shaft 119 and are permitted to rotate independent of one another. In other words, engagement of coupler plate 141 with keyed surface 125 causes coupler plate 141 to rotate with shaft 119. However, coupler bearing 139 remains stationary without any rotation as it refrains from contact with keyed surface 125. It is understood that a portion of coupler bearing 139 may rotate in some embodiments. In this case, coupler bearing 139 may include an inner body that rotates with shaft 119 but also include a stationary outer body. In this type of example, keyed surface 125 may run the length of shaft 119.

There is reason to maintain at least a portion of coupler bearing 139 free from rotation. Handle 113 is configured to pivotally couple to coupler housing 103. Handle 113 defines a primary axis 143 of rotation at the base of vertical members 131. Members 131 pass through lid 111 and extend into coupler housing 103 on either side of coupler bearing 139. The location of primary axis 143 is stationary. Vertical member 131 are also pivotally coupled to a nonrotating surface of coupler bearing 139 and define a secondary axis 145 of rotation for handle 113. Pivoting handle 113 about primary axis 143 alternates the position of coupler 117 between the engaged position and the disengaged position. Rotation of handle 113 about primary axis 143 permits the simultaneous rotation of handle 113 about secondary axis 145. Secondary axis 145 is located above primary axis 143 a set distance. The distance of separation of the axes determines the length of travel of coupler 117 along shaft 119. Secondary axis 145 is configured to translate with coupler bearing 139, such that it is not stationary relative to its location in coupler housing 103.

Figure 7:
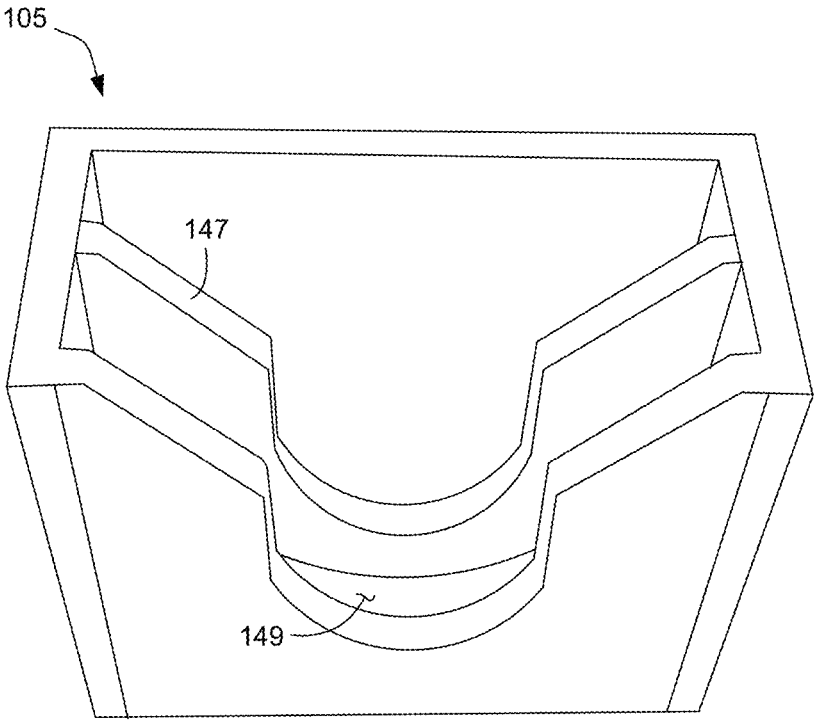
FIG. 7 is a perspective view of a bearing housing of the coiler bar assembly of FIG. 3.

Referring now also to FIG. 7 in the drawings, an enlarged perspective view of bearing housing 105 is illustrated. Bearing housing 105 houses second end 109 of shaft 95. Second bearing 110 is located within a slot defined between housing 105 and an internal partition 147. A bearing surface 149 is at the bottom of the slot and is designed to cradle up and around a portion of second bearing 110. The surface area of contact between surface 149 and second bearing 110 is increased to help distribute weights better. These same attributes apply equally to first bearing 108.

The current application has many advantages over the prior art including at least the following: (1) external lever control to engage and disengage a reel shaft from a motor;

(2) operation of free rotation or induced rotation of a reel shaft; and (3) larger surface area for the bearings to minimize load.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A coiler bar assembly, comprising:

a coupler housing having a first bearing;

a bearing housing having a second bearing;

a reel shaft having a first end and a second end, the first end engaging the first bearing and the second end engaging the second bearing;

a receiving plate coupled to the first end outside of the first bearing, the receiving plate configured to include a one or more apertures;

a coupler configured to alternate between an engaged position and a disengaged position, in the engaged position the coupler mates with the receiving plate, in the disengaged position the coupler is separated from the receiving plate;

a handle pivotally coupled to the coupler housing, the handle configured to pivot about a primary axis, pivoting of the handle about the primary axis alternates positions of the coupler; and a motor shaft passing through the coupler and ending adjacent the receiving plate, the coupler configured to selectively rotate about the shaft in the disengaged position and configured to engage the shaft in the engaged position.

2. The assembly of claim 1, wherein the first end and the receiving plate are located in the coupler housing.

3. The assembly of claim 1, wherein the motor shaft includes a keyed surface.

4. The assembly of claim 3, wherein the keyed surface is located at a distal end of the motor shaft.

5. The assembly of claim 3, wherein the keyed surface is a set of external teeth.

6. The assembly of claim 1, wherein the coupler is configured to translate along the motor shaft.

7. The assembly of claim 1, wherein the coupler includes a coupler bearing and a coupler plate, the coupler plate is configured to rotate independent from the coupler bearing.

8. The assembly of claim 7, wherein the handle is pivotally coupled to the coupler bearing about a secondary axis, such that rotation of the handle about the primary axis permits simultaneous rotation about a secondary axis.

9. The assembly of claim 7, wherein the coupler housing includes a lid.

10. The assembly of claim 9, wherein the lid includes at least one set of apertures connected via a slot.

11. The assembly of claim 10, wherein the slot is aligned with the motor shaft.

12. The assembly of claim 10, wherein the handle includes a translating sleeve about a vertical member, the translating sleeve configured to move linearly along the length of the vertical member.

13. The assembly of claim 12, wherein the handle includes a spring configured to define a resting position of the translating sleeve.

14. The assembly of claim 12, wherein the translating sleeve is configured to pass within at least one of the set of apertures and the vertical member is configured to pass through the slot.

15. The assembly of claim 12, wherein the translating sleeve is larger than a width of the slot.

16. The assembly of claim 9, wherein the handle includes a pair of vertical members, the vertical members passing through the lid and extending on either side of the coupler bearing.

17. The assembly of claim 16, wherein the vertical members are pivotally coupled to both the coupler housing via the primary axis and the coupler bearing via a secondary axis.

18. The assembly of claim 1, wherein the motor shaft is mechanically driven so as to selective impart rotation of the motor shaft.

19. The assembly of claim 1, wherein the coupler is located in the coupler housing.

20. The assembly of claim 1, further comprising:

a motor in communication with the motor shaft, the motor configured to induce rotation of the motor shaft.

* * * * *